United States Patent [19]

Ottosson et al.

[11] 3,968,822

[45] July 13, 1976

[54] METHOD AND INSTALLATION FOR SAWING TIMBER

[75] Inventors: Per Axel Rune Ottosson; Claes Emil Lennart Otterbeck, both of Nybro, Sweden

[73] Assignee: Kahrs Maskiner Aktiebolag, Sweden

[22] Filed: Apr. 25, 1974

[21] Appl. No.: 464,228

[30] Foreign Application Priority Data

Apr. 27, 1973 Sweden ..... 7306009

[52] U.S. Cl. ..... 144/312

[51] Int. Cl.[2] ..... B27B 1/00

[58] Field of Search ..... 144/312; 83/23

[56] References Cited

UNITED STATES PATENTS

| | | | |
|---|---|---|---|
| 3,456,700 | 7/1969 | Ahlstedt | 144/312 |
| 3,513,321 | 5/1970 | Sherman | 144/312 |
| 3,554,249 | 1/1971 | Arnelo | 144/312 |
| 3,806,253 | 4/1973 | Denton | 144/312 |

*Primary Examiner*—Donald R. Schran
*Attorney, Agent, or Firm*—Robert E. Burns; Emmanuel J. Lobato; Bruce L. Adams

[57] ABSTRACT

A method for sawing logs to obtain unit stacks of boards of a desired number of boards of a same cross section. The logs are presorted by diameter into groups within which each log selected has a sawing yield of a number of boards of a same cross section. The logs are fed from one or more groups to a saw mill for sawing them longitudinally and equal in number to yield a number of boards of a same cross section from the center yield thereof equal to a stack unit of the desired number of boards of the same cross section. The boards obtained by sawing are stacked as a stack unit of the desired number of boards without further sorting.

2 Claims, 3 Drawing Figures

METHOD AND INSTALLATION FOR SAWING TIMBER

BACKGROUND OF THE INVENTION

In sawing timber, the maximum timber yield from the timber fed into the sawmill in question is attempted in most cases. A number of methods of approach have been previously proposed to achieve such a result. For example, there are such installations in which the timber, independent of dimensions and nature, may be fed into the sawmill and there examined and processed taking into account the different dimensions and qualities of the individual logs to attain the best timber yield. Such plants generally require a high degree of mechanization and computer control of the working cycle. A method which is also usual is to carry out a certain rough sorting of the timber which is to be sawn, and to feed certain log dimensions in sequence to a pre-set sawing apparatus.

Common to all the types of sawmills mentioned above is that a very advanced and space-requiring sorting plant is required for the timber which is obtained, and which thereafter must often be stacked in certain stacking sizes to suit the timber seasoning plant and transport. In such installations there will often be a great need of storage space in connection with the sorting bays. From the point of view of rationalization, it may therefore be necessary to waive the requirement for maximum timber yield to a certain extent, in order to avoid, amongst other things, large and expensive timber sorting plants in conjunction with the sawing tables in question.

SUMMARY OF THE INVENTION

The present invention is intended as a solution to the problems mentioned, and provides an installation where practically no timber sorting in the proper sense takes place, which reduces installation costs and simplifies operation to a considerable degree.

The method according to the invention is a method of sawing logs for obtaining therefrom wooden board stack units of a desired number of boards of a given same cross section within each stack unit by the steps of presorting by diameter of logs into groups within which each log selected has a sawing yield of an equal number, or otherwise, of boards of a same cross section as a center yield thereof. The logs are fed from one or more of the groups to a saw mill for sawing them longitudinally and equal in number to yield a number of boards of a same cross section from a center yield thereof equal to a stack unit of a desired number of boards of a same cross section. The boards obtained by sawing are stacked into an individual stack unit of the desired number of boards of a same cross section without further sorting.

The distinguishing features of the present invention are apparent from the following patent claims.

BRIEF DESCRIPTION OF THE DRAWINGS

The invention will now be more closely described in connection with an embodiment example, while referring to the attached drawing.

DESCRIPTION OF THE PREFERRED EMBODIMENTS

The present invention concentrates on the so-called "centre yield" of the log, i.e. the middle portion of the respective log. This is important against the background of consequent drying in seasoning plants. In practice it is generally so that the timber is stacked in so-called "seasoning bundles" having a certain specified dimension and volume to suit the seasoning plant in question. It is therefore easy to calculate how many timber units of a certain dimension which are required to form such a seasoning bundle or stack. If one thus calculates that the centre yield for a certain log dimension results in a definite plank dimension, one can simply calculate how many such planks which are required for making a seasoning bundle. In general, one reckons that two planks are obtained from the centre yield in each individual log. If such a timber sorting measure were taken that a number of logs equivalent to half the amount of planks in a seasoning packet were fed in sequence for sawing, a full timber bundle would be obtained directly without readjustment from the said amount of logs. According to the invention the procedure is thus that such an amount of logs of a given dimension is fed into the sawmill, that the amount of timber in the centre yield gives a timber volume corresponding to the volume in a seasoning bundle or other unit stack, e.g. the transport stack.

Figure 1:
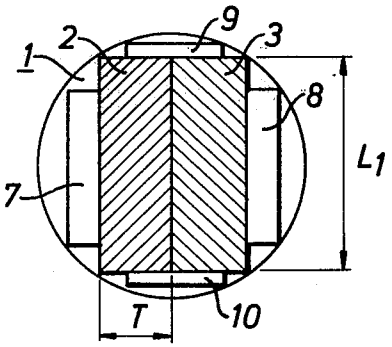
FIG. 1 shows diagrammatically and in section a log with the timber yield which can be reckoned to be obtained from it.
Figure 2:
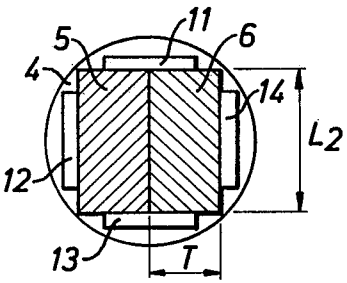
FIG. 2 shows a similar section through a log having a smaller diameter than the one in FIG. 1.

To further clarify the inventive idea, FIGS. 1 and 2 will be more closely described. In the log 1 shown in FIG. 1 it is desired to place the sawcut so that a centre yield of two planks 2,3 with thickness T and width $L_1$ are obtained. In the log 4 shown in FIG. 2 the sawcut is arranged so that the centre yield results in two planks 5,6 each having the thickness T, i.e. the same as the thickness of planks 2,3. The width $L_2$ on the other hand, is for natural reasons less than the width $L_1$ of planks 2 and 3. In such a simplified case it may be assumed that there are only two such timber dimensions, and that the sawmill is suited to providing the necessary sawcuts for the centre yield in question of the logs 1 and 4. If it is assumed that a full seasoning bundle can be made up from 100 planks 2,3 from logs according to FIG. 1, the process is that the logs according to FIG. 1 are sorted in bundles, e.g. in racks preferably after associated de-barking treatment, with 50 logs in each bundle. By sawing such a bundle of 50 logs along the sawcut in FIG. 1, the sawing result will automatically be an amount of timber exactly corresponding to a desired full seasoning bundle containing 100 planks.

In a similar manner a number of logs 4 are bundled, corresponding to half the number of planks 5,6 required for building up a full seasoning bundle. After proper re-setting of the devices controlling the sawcuts, the logs 4 are sawn in bundle batches whereat the result from each bundle will automatically be a full seasoning bundle. As may be seen, extremely simple handling is obtained through such a method for achieving full timber stacks of determined dimensions. The only measures which need be taken are to sort the logs in bundles with a previously determined number in the respective dimension, in order to ensure continuously equal amounts of timber per bundle as a result.

When the logs are sawn in the manner as shown in FIGS. 1 and 2, a side yield is naturally always obtained.

For the log 1 at the long sides of planks 2,3, two side yields in the form of planks 7,8 are obtained while along the short sides planks 9,10 of smaller dimensions are obtained. With the logs according to FIG. 2 the centre yield dimensions are such that four equally large planks 11,12,13 and 14 are obtained as side yield. With logs of different dimensions it is advantageous to place the sawcuts so that at least certain planks in the side yield of the different logs can result in the same width dimensions. In the present case the sawcut has been placed so that planks 9 and 10 have the same dimensions as boards 11–14. At treatment during sawing, the side yields in regard to log 1 are treated so that the finished planks 7,8 are led to a first rack, while planks 9 and 10 are removed to a second rack. When the logs 4 are sawn, all the planks 11,12,13 and 14 are put into said second rack. As may be seen, in the present case only two different storage racks are required for the side yield. While sawing said bundles of logs the planks 7 and 8 are stored in said first rack and planks 9–14 in said second rack continuously during the sawing operations. A certain number of planks 7,8, for example, are needed to form a seasoning bundle. The sorting rack can suitably be equipped with a counter for counting the number planks required for forming said seasoning bundle, whereafter at a full number of the timbers in question, they are conveyed further for stacking to form a timber bundle. The same conditions apply to planks 9–14. In such a method for processing timber certain timber losses are unavoidably obtained, and these losses can be substantially counterbalanced by the rationalization gains obtained with said process.

Figure 3:
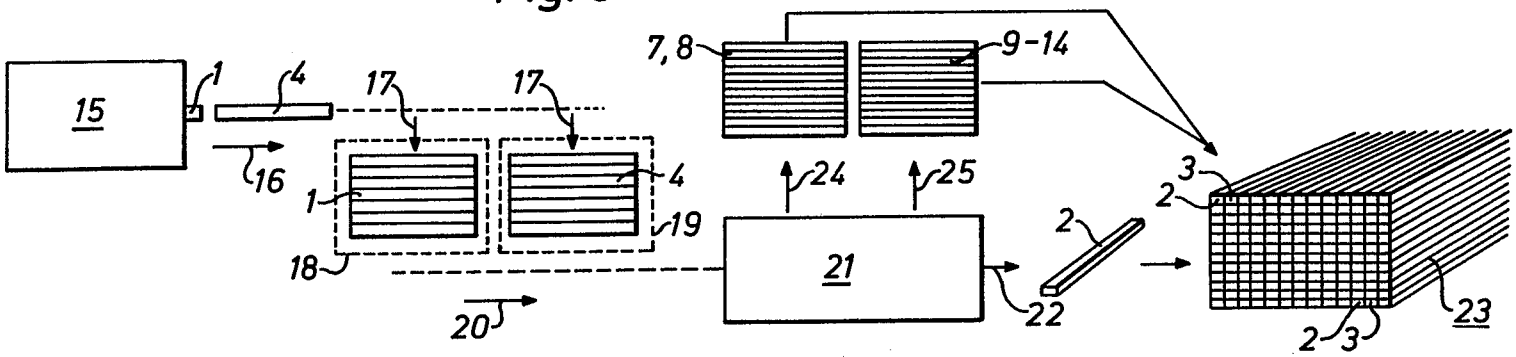
FIG. 3 shows a block diagram of a sawmill according to the present invention.

FIG. 3 is referred to as an exemplification of a plant according to the present invention. It is assumed that logs 1 and 4 are fed out from a de-barking installation generally designated 15 in the direction of arrow 16. The logs are sorted in dimensions hereafter, in a way not more closely shown, and are led in the direction of arrows 17 to racks 18,19 shown with dotted lines. In said racks the logs are collected to a number corresponding to the timber amount composing the centre yield in a seasoning bundle. When the necessary amount of logs has been arrived at in a rack, these are fed out in sequence in the direction of arrow 20 into the sawmill denoted by the rectangle 21. As a result of sawing, apart from the centre yield, planks 2 and 3 are obtained if the logs 1 are fed into the sawmill. Said planks 2,3 are fed in the direction of arrows 22 directly to stacking into a seasoning bundle diagrammatically shown and generally designated by 23, said seasoning bundle will thus contain planks of type 2 and 3. When such a bundle is completed, the amount of logs fed in has also been sawn up. As was stated, the side yield is obtained in the form of planks. From the sawmill 21 planks 7,8 are fed out in the direction of arrow 24 to a storage rack, not shown. Further, planks 9–14 are fed out in the direction of arrow 25 to a storage rack not shown. When a number of planks 7,8 or 9–14 have been reached in the respective rack, corresponding to a full seasoning bundle, the timber amount in question is fed out for stacking up into a seasoning bundle. As may be seen, an extremely rational handling of both logs and timber is obtained through the invention.

In the example described above the simplest form of timber handling according to the invention has been described so that the basic idea of the invention is clearly illustrated. It is obvious that the invention can be varied with a plurality of devices for sawing, a plurality of different log dimensions and the removal of a plurality of centre yield dimensions, compared with what has been shown here. The working principle for such a sawmill is, however, simple, since the logs are presorted in dimensions essentially according to conventional methods, although each sorting rack contains a balanced number of logs the centre yield of which after sawing will correspond to the number of planks which are required to obtain a complete seasoning bundle. The sawing line itself can be built up from machines which are re-adjustable during operation and which are fed with the sorted logs in groups in decided numbers without the groups being mixed. The mill can be constructed so that it auto-indicates when dimension change takes place between the groups, and thereby carry out the necessary operations for re-adjusting of the sawn dimension. Within the scope of the invention, the side yield can be taken out either directly ready edge sawn in the sawmill itself, or with the edge sawn in a conventional manner in an edging mill, the difference being that the number of side yields is always taken so that the same dimensions are taken out in sequence, until a complete seasoning bundle of the side yield is obtained before a change in dimension is made. As the side yield of the same dimension (it may be several dimensions in parallel) must be taken during the time when several dimension groups of logs are passing through the saw, the dimension adjustment of the saw is suitably arranged so that a suitable combination of log diameter groups and dimension requirements in the sawmill are sawn in such a sequence that the above is possible. The side yield dimensions are suitably arranged so that an adjustment in the dimension during processing of the same log dimension gives as small a yield loss as is possible. This can be done for example by coordinating log sorting and dimension adjustment in the sawmill with controlling and calculating means where consideration can be taken to current dimension desires. For example in the case shown in FIGS. 1 and 2, the planks 2 and 3 have the same thickness as planks 5 and 6, which can be suitable as a guiding line for setting up and sawing of different log dimensions, namely that the plank thickness is kept constant while the plank width may be varied.

What we claim is:

1. A method of sawing logs for obtaining therefrom wooden board stack units of a desired number of boards of a given same cross section within each stack unit comprising the steps of, presorting by diameter a plurality of logs into groups within which each log selected has a sawing yield of a number of boards of a same cross section as a center yield thereof, feeding logs from at least one of said groups to a saw mill for sawing them longitudinally and equal in number to yield a number of boards of a same cross section from a center yield thereof equal to a stack unit of a desired number of boards of a same cross section, and stacking the boards obtained by sawing from said at least one group of logs into a stack unit of said desired number of boards of a same cross section without further sorting.

2. A method of sawing logs for obtaining therefrom wooden board stack units of a desired number of boards of a given same cross section within each stack unit comprising the steps of, presorting by diameter a plurality of logs into groups within which each log selected has a sawing yield of an equal number of boards of a same cross section as a center yield thereof, feeding logs from at least one of said groups to a saw mill for sawing them longitudinally and equal in number to yield a number of boards of a same cross section from a center yield thereof equal to a stack unit of a desired number of boards of a same cross section, and stacking the boards obtained by sawing from said at least one group of logs into a stack unit of said desired number of boards of a same cross section without further sorting.

* * * * *